United States Patent [19]

Ball et al.

[11] Patent Number: 4,558,257

[45] Date of Patent: Dec. 10, 1985

[54] TRAVELLING WAVE TUBE ARRANGEMENTS

[75] Inventors: Cyril T. Ball, Marks Tey; Peter Tourle, Chelmsford; Robert L. Wright, Coggeshall, all of England

[73] Assignee: English Electric Valve Company, Limited, Chelmsford, England

[21] Appl. No.: 565,257

[22] Filed: Dec. 23, 1983

[51] Int. Cl.[4] ..... H01J 23/02

[52] U.S. Cl. ..... 315/5.38; 315/3.5; 315/39

[58] Field of Search ..... 315/3.5, 5.38, 39

[56] References Cited

U.S. PATENT DOCUMENTS

| | | | |
|---|---|---|---|
| 3,317,780 | 5/1967 | Ayers | 315/5.38 X |
| 3,634,723 | 1/1972 | Gross et al. | 315/3.5 |
| 4,270,070 | 5/1981 | Gross | 315/3.5 |
| 4,358,704 | 11/1982 | Conquest | 315/3.5 |

FOREIGN PATENT DOCUMENTS

| | | |
|---|---|---|
| 947566 | 1/1964 | United Kingdom . |
| 1238822 | 7/1971 | United Kingdom . |
| 1277336 | 6/1972 | United Kingdom . |
| 1336408 | 11/1973 | United Kingdom . |
| 1337539 | 11/1973 | United Kingdom . |
| 1376579 | 12/1974 | United Kingdom . |

*Primary Examiner*—Robert Lindsay

*Attorney, Agent, or Firm*—Spencer & Frank

[57] ABSTRACT

A travelling wave tube arrangement is provided in which in order to support and cool the collector thereof the latter is cradled between two slabs of beryllium oxide attached to the walls of a channel in a block of copper, which walls are inclined in V-fashion. A further slab of beryllium oxide is provided above the collector. This last mentioned slab is attached to a flexible copper alloy wall which is dependent from a copper alloy plate which extends across the top of the channel. The plate is brazed to the block. A screw passing through the plate exerts pressure upon said flexible wall which in turn urges the beryllium oxide plate carried thereby towards the collector thus pressing the latter between the three beryllium oxide plates to form a electrically insulating support of good thermal conductivity. The invention is also applicable to travelling wave tubes having multiple collectors, each collector being cradled between common slabs of beryllium oxide and subjected to pressure via a common slab of the same above the collectors.

11 Claims, 2 Drawing Figures

TRAVELLING WAVE TUBE ARRANGEMENTS

BACKGROUND OF THE INVENTION

This invention relates to travelling wave tube arrangements.

As is well known the collector of a travelling wave tube, which usually comprises a hollow copper cylinder, requires to be cooled in operation. The amount of heat which requires to be dissipated is very considerable and it has been common practice to incorporate some provision for cooling in a mounting arrangement supporting the travelling wave tube. One complication with such an arrangement is that the travelling wave tube collector requires to be electrically isolated.

Whilst the above remarks are directed to travelling wave tubes each having a single collector, similar remarks apply to travelling wave tubes having multiple collectors (usually operated at different electrical potentials).

SUMMARY OF THE INVENTION

The present invention seeks to provide an improved travelling wave tube arrangement in which the collector or collectors is or are both satisfactorily mounted and cooled.

According to this invention a travelling wave tube arrangement is provided in which a collector electrode of the travelling wave tube is cradled between two inclined surfaces of cradling means of an electrically insulating material of good thermal conductivity and a pressure member, also of electrically insulating material of good thermal conductivity, is provided to exert pressure upon said collector in order to press the same between said inclined surfaces and said pressure member, said cradling means and said pressure member being supported by a body which is itself of a good heat conducting material.

Preferably said body comprises a block having therein a channel whose walls are inclined one to the other in V-fashion towards the base thereof and said cradling means comprises two slabs of electrically insulating material of good thermal conductivity attached one to one and the other to the other of the inclined walls of said channel.

Preferably said pressure member comprises a slab of electrically insulating material of good thermal conductivity, mounted upon a flexible wall of a material of good thermal conductivity and means are provided for exerting pressure upon said flexible wall to urge said pressure member towards said collector.

Preferably said last mentioned means comprises a plate of a material of good thermal conductivity extending across the opening or top of said channel and fixed to said block, which plate has attached thereto, on its surface facing said collector, said flexible wall, a screw or other device capable of exerting pressure, being provided to pass through said plate and exert pressure on said flexible wall to urge said pressure member carried thereby towards said collector.

Preferably said electrically insulating material of good thermal conductivity is beryllium oxide.

In the case of a travelling wave tube having multiple collectors, said cradling means and said pressure member are common to all of said collectors.

According to a feature of this invention the collector or collectors may be within the envelope of said travelling wave tube. Preferably, in this case, said flexible wall forms part of the envelope of said tube.

BRIEF DESCRIPTION OF THE DRAWINGS

The invention is illustrated in and further described with reference to the accompanying drawings in which.

DESCRIPTION OF THE PREFERRED EMBODIMENTS

Figure 1:
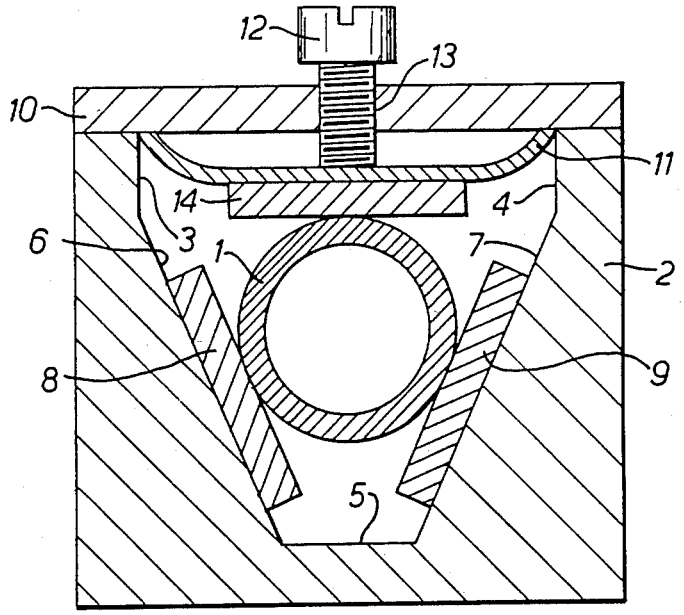
FIG. 1 is a cross-section through the collector section of one travelling wave tube arrangement in accordance with the present invention.

Referring to FIG. 1, the collector of the travelling wave tube, which is of copper, is represented at 1. The collector 1 is of conventional cylindrical form.

Surrounding collector 1 is a channel-sectioned block of copper 2 of which the inner walls 3, 4 taper inwardly towards the base 5 of the channel. Thus, towards the base 5, the channel presents opposite walls 6, 7, which are inclined one to the other in V-fashion.

The block 2 is in fact not unlike an engineer's V-block in shape.

On each inclined wall 6, 7 is a slab 8, 9 of beryllium oxide (BeO) which together form a cradle for the collector 1.

Above the collector 1 the top of the channel in the block 2 is closed by a copper alloy plate 10. Plate 10 is brazed to the top of the block 2.

On the underside of the plate 10 is a deformable copper alloy wall 11, whilst a screw 12 bearing upon deformable copper alloy wall 11 passes through a threaded hole 13 in the plate 10.

On the underside of deformable copper alloy wall 11 is another slab 14 of beryllium oxide the underside of which contacts the top of the collector 1. Thus the slabs 8, 9 and 14 of beryllium oxide contact the collector 1 at three points around the circumference thereof.

When assembled as described above, screw 12 is then tightened to press the collector 1 between the slabs 8, 9 and 14 whereby not only to support and retain the collector 1 but also, since beryllium oxide is not only a good heat conductor but also an insulator from the electrical point of view, to provide a good thermal path between the collector 1 and the copper block 2 whilst maintaining electrical isolation one from the other. Screw 12 is locked by any convenient means once adjusted.

Copper block 2 is itself mounted upon a heat sink so as to be cooled by conduction.

In this example, block 2 and wall 11 form part of the vacuum-tight envelope of the travelling wave tube so that the collector 1 is within the tube envelope with screw 12 accessible from without.

Figure 2:
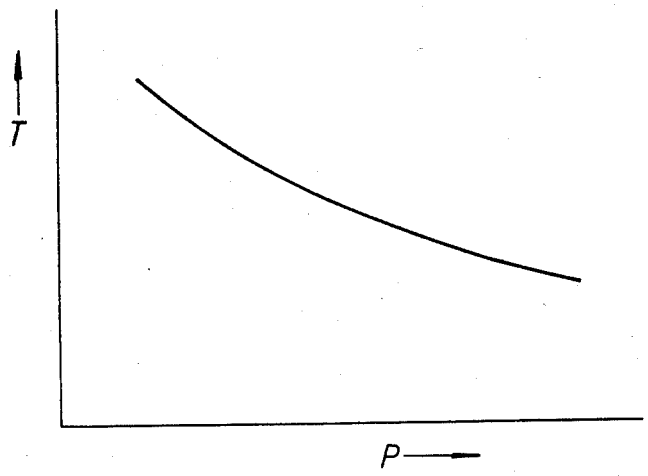
FIG. 2 is an explanatory graph.

The graph shown in FIG. 2 represents a typical relationship between the pressure P exerted upon the collector 1 by means of the screw 12 and the temperature of the collector 1, and thus illustrates the cooling effect achieved.

What is claimed is:

1. A travelling wave tube arrangement in which a collector electrode of the travelling wave tube is cradled between two inclined surfaces of cradling means of an electrically insulating material of good thermal conductivity and a pressure member also of electrically insulating material of good thermal conductivity is provided to exert pressure upon said collector in order to press the same between said inclined surfaces and said pressure member, said cradling means and said pressure member being supported by a body which is itself of a good heat conducting material.

2. An arrangement as claimed in claim 1 and wherein said body comprises a block having therein a channel whose walls are inclined one to the other in V fashion towards the base thereof, and said cradling means comprises two slabs of electrically insulating material of good thermal conductivity attached one to one and the other to the other of the inclined walls of said channel.

3. An arrangement as claimed in claim 2 and wherein said pressure member comprises a slab of electrically insulating material of good thermal conductivity mounted upon a flexible wall of a material of good thermal conductivity and means are provided for exerting pressure upon said flexible wall to urge said pressure member towards said collector.

4. An arrangement as claimed in claim 3 and wherein said last-mentioned means comprises a plate of a material of good thermal conductivity extending across the opening or top of said channel and fixed to said block which plate has attached thereto on its surface facing said collector, said flexible wall, a screw or other device capable of exerting pressure being provided to pass through said plate and exert pressure on said flexible wall to urge said pressure member carried thereby towards said collector.

5. An arrangement as claimed in claim 4 and wherein said electrically insulating material of good thermal conductivity is beryllium oxide.

6. An arrangement as claimed in claim 1 and wherein said electrically insulating material of good thermal conductivity is beryllium oxide.

7. A travelling wave tube as claimed in claim 1 and having multiple collectors, said cradling means and said pressure member being common to all of said collectors.

8. A travelling wave tube as claimed in claim 1 and wherein the collector is within the envelope of said tube.

9. A travelling wave tube as claimed in claim 7 and wherein the collectors are within the envelope of said travelling wave tube.

10. A travelling wave tube as claimed in claim 3 and wherein said collector is within the envelope of said tube, said flexible wall forming part of said envelope.

11. A travelling wave tube as claimed in claim 10 and wherein said flexible wall and said body form part of said envelope.

* * * * *